US008113739B2

(12) United States Patent
Mito et al.

(10) Patent No.: US 8,113,739 B2
(45) Date of Patent: Feb. 14, 2012

(54) SAND DRIFT PREVENTION METHOD, METHOD OF FORMING AND IMPROVING VEGETATION IN SANDY SOIL USING THE SAME, AND TUBULAR KNIT FABRIC FOR COLUMNAR SANDBAG

(75) Inventors: Osamu Mito, Osaka (JP); Kazuya Matsumura, Osaka (JP); Koji Sasaki, Osaka (JP); Takenobu Okumura, Tottori (JP); Shigeto Matsumoto, Echizen (JP); Makoto Maeda, Echizen (JP)

(73) Assignees: Toray Industries, Inc., Tokyo (JP); Mitsukawa & Co., Ltd., Fukui (JP)

( * ) Notice: Subject to any disclaimer, the term of this patent is extended or adjusted under 35 U.S.C. 154(b) by 0 days.

(21) Appl. No.: 12/149,061

(22) Filed: Apr. 25, 2008

(65) Prior Publication Data

US 2008/0279630 A1 Nov. 13, 2008

(30) Foreign Application Priority Data

Apr. 27, 2007 (JP) ..... 2007-117999

(51) Int. Cl.
*E02B 3/12* (2006.01)
*D03D 1/04* (2006.01)

(52) U.S. Cl. ..... 405/17; 405/302.6

(58) Field of Classification Search ..... 405/15, 405/36, 207, 302.6, 17, 19
See application file for complete search history.

(56) References Cited

U.S. PATENT DOCUMENTS

| | | | | |
|---|---|---|---|---|
| 2004/0132860 | A1* | 7/2004 | Takahashi et al. | 523/124 |
| 2005/0054810 | A1* | 3/2005 | Yamada et al. | 528/272 |
| 2005/0254899 | A1* | 11/2005 | Tyler | 405/15 |
| 2007/0266491 | A1* | 11/2007 | Gann | 4/613 |

FOREIGN PATENT DOCUMENTS

| | | |
|---|---|---|
| CN | 2673943 | 1/2005 |
| JP | 08-041830 A | 2/1996 |
| JP | 2000-34709 A | 2/2000 |
| JP | 2005-68832 A | 3/2005 |

OTHER PUBLICATIONS

Zhang, Wang-xi et al., "The Synthesis and Spinning of Poly(lactic acid) Fibers and Their Applications", Journal of Zhongyuan Institute of Technology, pp. 1-4, vol. 16, No. 3, Jun. 2005.

* cited by examiner

*Primary Examiner* — Tara Mayo-Pinnock
(74) *Attorney, Agent, or Firm* — Kubovcik & Kubovcik

(57) ABSTRACT

A sand drift prevention method in which a plurality of columnar sandbags made of a tubular knit fabric are placed so as to cross over one another, and in such a pitch that 3 to 30 sandbags are disposed for every ten meters, and in which the cross-sectional area of each of the columnar sandbags is 10 to 400 $cm^2$. A method of forming and improving the vegetation in sandy soil in which drift of sand is prevented by the sand drift prevention method, a plant desired to grow is grown in the sandy soil surface exposed as being surrounded by columnar sandbags placed so as to cross over one another. A tubular knit fabric for a columnar sandbag employed in these methods, and, in particular, the tubular knit fabric knitted by use of a polylactic-acid fiber.

8 Claims, 2 Drawing Sheets

SAND DRIFT PREVENTION METHOD, METHOD OF FORMING AND IMPROVING VEGETATION IN SANDY SOIL USING THE SAME, AND TUBULAR KNIT FABRIC FOR COLUMNAR SANDBAG

TECHNICAL FIELD

The present invention relates to a sand drift prevention method, which is a method employed for preventing the sand from drifting, over the years, by the force of the wind and the like in places where the ground surface is extensively covered with sand, such as desert areas, sand dunes, and beaches. The present invention also relates to a method of forming and improving the vegetation, as desired, in sandy soil by employing the above-mentioned sand drift prevention method.

In addition, the present invention relates to a tubular knit fabric that is used in the sand drift prevention method, or in the method of forming and improving the vegetation in sandy soil.

BACKGROUND ART

In Inner Mongolia area in China, there is a mobile sand dune area that drifts and expands by the strong wind. The sand dune area is a typical example of the places where the ground surface is extensively covered with sand, such as desert areas, sand dunes, and beaches, and where the sand drifts on a massive scale by the force of the wind and the like. The desertification in this area is said to progress by such factors as the overgrazing of Cashmere goats or sheep as well as the encroaching sand that buries the plants. The sand is accused to be the cause of the sand dust that did damage to the near-by villages and the coastal areas of China, and to be the cause of the yellow sand phenomenon in South Korea and Japan. Not only people living in China, but also those in Japan are now calling for the lessening of the damage caused by the sand blown up from the mobile dune area.

Inner Mongolia area has a high precipitation for a desert region, and as a result has a high groundwater level. So, the greening of this area is considered to be possible if the sand near the ground surface is prevented from being moved by the strong wind and is thus fixed. What is called a straw checkerboard has been employed as a time-honored means of carrying out the greening.

The greening method called the straw checkerboard method is a sand controlling method using straw. In the method, firstly, lines are drawn in a grid pattern with intervals of, for example, one meter, on the surface of sandy soil. Then, the soil is shoveled to form grooves along the grid-patterned lines. After that, straw and the like are set up in the grooves while the bare-ground parts inside the grid lines are seeded. Accordingly, a state where the sand is more difficult to drift when viewed in totality can be accomplished and, in addition, the sandy soil can be converted into grassy pastures. The straw and the like, however, are not obtained easily. In addition, transporting the bulky straw and the like to the venue is difficult (note the necessity of transportation on the sandy soil). Moreover, the straw and the like deteriorate, so that replacement is needed every two or three years. In other words, there is a problem concerning the maintenance and the management after the setting up of the straw checkerboard.

A method in which used tires, arranged appropriately, are buried and fixed in the ground (see Patent Document 1, for example) is an example of methods of preventing the soil from flowing out and the like. Another example of the kind is a method in which sandbags having a certain structure and made of a certain material are fixed on the ground and linked together (see Patent Document 2, for example). Though methods, including these described above, have been proposed thus far, we have not yet discovered a method of efficiently fixing sand in a vast mobile sand dune area or in a sand dune.

Nor have we discovered yet a method of efficiently fixing sand in a vast mobile sand dune area or in a sand dune and thus greening the land efficiently.

Patent Document 1: Japanese patent application Kokai publication No. 2000-34709

Patent Document 2: Japanese patent application Kokai publication No. 2005-68832

DISCLOSURE OF INVENTION

The present invention has been made in view of the above-described state of the background art and of the natural environmental problems of recent years. The present invention therefore has an object to provide a sand drift prevention method using a sandbag made of a light-weight material which gives favorable foldability to the sandbag and which, as a result, is easily transported even in desert areas and the like. The sandbag to be used is also easy to be worked with at the installation thereof, so that the installation work is less burdensome to the workers. In addition, the sandbag to be used can reduce the resources to be used down to the minimum level. The present invention aims also to provide a method of improving the vegetation using the sand drift prevention method.

Furthermore, still another object of the present invention is to provide a tubular knit fabric for a sandbag that is most suitably used in the sand drift prevention method as well as in the method of forming and improving the vegetation in sandy soil.

A sand drift prevention method according to the present invention has the following configuration (1) for the purpose of solving the above-described problems.

(1) A sand drift prevention method characterized in that a plurality of columnar sandbags made of a tubular knit fabric with sand being filled inside the tube are placed on a sandy soil surface so as to cross over one another and thereby sand is prevented from drifting.

In addition, to be more specific, the sand drift prevention method according to the present invention preferably has any one of the following configurations (2) to (5).

(2) The sand drift prevention method according to the above-described configuration (1) characterized in that the columnar sandbags are placed at such a pitch that 3 to 30 sandbags are disposed for every ten meters.

(3) The sand drift prevention method according to any one of the above-described configurations (1) and (2) characterized in that the cross-sectional area of each of the columnar sandbags is 10 to 400 $cm^2$.

(4) The sand drift prevention method according to any one of the above-described configurations (1) to (3) characterized in that the tubular knit fabric is knitted by use of a polylactic-acid fiber.

(5) The sand drift prevention method according to any one of the above-described configurations (1) to (4) characterized in that a knit fabric with a cover factor of 5 to 20 is used as the tubular knit fabric. The cover factor mentioned above is obtained in accordance with JIS L 1018 8.10.

In addition, a method of improving the vegetation according to the present invention to achieve the above-mentioned objects has the following configuration (6).

(6) A method of forming and improving the vegetation in sandy soil characterized in that drift of sand is prevented by the sand drift prevention method according to the above-described configuration (1), a plant desired to grow is grown in the sandy soil surface exposed as being surrounded by columnar sandbags that are placed so as to cross over one another, and thereby the vegetation of the sandy soil surface is changed.

In addition, a knit fabric according to the present invention to achieve the above-mentioned objects has the following configuration (7).

(7) A tubular knit fabric for a columnar sandbag characterized in that the tubular knit fabric is employed in any one of the sand drift prevention method according to the above-describe configuration (1) and the method of forming and improving the vegetation in sandy soil according to the above-described configuration (6).

Moreover, to be more specific, the tubular knit fabric for a columnar sandbag according to the present invention preferably has the following configuration (8).

(8) The tubular knit fabric for a columnar sandbag according to the above-described configuration (7) characterized in that the columnar knit fabric is knitted by use of a polylactic-acid fiber.

EFFECTS OF THE INVENTION

According to the sand drift prevention method of the present invention, the filling of the sandbag with the sand that is available at the venue of installation allows easy transportation of the sandbag while the light-weight and excellently foldable sandbag per se also allows easy transportation thereof. In addition, the sandbag to be used in the method is also easy to be worked with at the installation thereof, so that the installation work is less burdensome to the workers. In addition, the stopping of the drift of the sand accomplished efficiently by use of the sandbags with small amount of sand can reduce the resources to be used down to the minimum level.

According to the method of forming and improving the vegetation in sandy soil of the present invention, a change takes place in vegetation in sandy soil from the one that has existed thus far in places where the ground surface is extensively covered with sand, such as desert areas, sand dunes, and beaches. Specifically, growing plants that are desired is possible, and thus reduction in the damages caused by the sand from the sandy soil is achieved.

According to the tubular knit fabric for a columnar sandbag of the present invention, the light-weight and easy-to-handle tubular knit fabric that is knitted as a long continuous tubular shape is transported easily in a form of being wound up or folded appropriately. The tubular knit fabric is thus transported easily to the venue or to the near-by places thereof for the implementation of the above-described sand drift prevention method or of the above-described method of forming and improving the vegetation. Making the sandbags is done exactly at the venue by filling the columnar, tubular knit fabric with the sand of the sandy soil. The tubular knit fabric is cut in an appropriate length so as to make the sandbag thus formed fit to the situation at the venue for installation and to facilitate the handling of the sandbag. A sandbag with sand being enclosed completely is made by knotting the end portions of each cut piece of the tubular knit fabric.

Each columnar sandbag thus formed is ordinarily lengthy to a certain degree, but the sandbag is made of a flexible knit fabric and filled with sand that has no definite shape. Accordingly, the columnar sandbag appropriately fits to irregular terrain surface of the sandy soil where the sandbag is placed, so that the sandbag has a favorable effect of sand drift detection.

The knit fabric knitted with the bio-degradable polylactic-acid based fiber allows the columnar sandbag to decompose within several to several tens of years after the placement on the sandy ground. Accordingly, the columnar sandbag never remains in perpetuity as a man-made object in the sandy soil.

In addition, the sand filled in the sandbag is originally the very sand of the venue. Accordingly, there is hardly a concern or a risk of another kind of destruction for the natural environment that would be caused by foreign matter.

For these reasons, the knit fabric according to the embodiments of the present invention are a suitable knit fabric used to implement the sand drift prevention method as well as to implement the method of forming and improving the vegetation in sandy soil of the present invention.

DESCRIPTION OF SYMBOLS

1: Sandy soil, such as a mobile sand dune area
2: Columnar sandbag
3: Sandbag used in Comparative Example 2

BEST MODE FOR CARRYING OUT THE INVENTION

A preferred embodiment of the present invention will be described below.

A sand drift prevention method of the present invention is characterized in that plural columnar sandbags made of a tubular knit fabric with sand being filled inside the tube are placed on a sandy soil surface so as to cross over one another and thereby sand is prevented from drifting.

Figure 1:
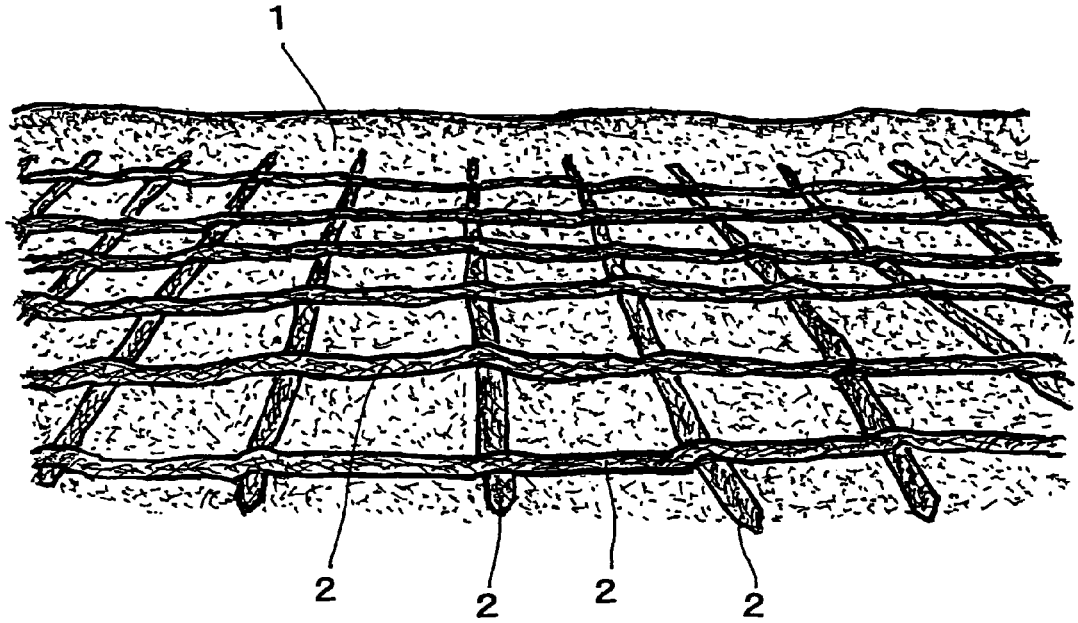
FIG. 1 is a sketchy outline view showing a rough model of a state where a sand drift prevention method according to the present invention is implemented.

FIG. 1 is a sketchy outline view showing a rough model of a state where the sand drift prevention method of the present invention is implemented. FIG. 1 shows a state where plural columnar sandbags 2 each made of tubular knit fabric filled with sand are placed in a predetermined pitch so as to cross over one another on the surface of sandy soil 1, such as one of a mobile sand dune area. Placement of sandbags on the surface of sandy soil in this way allows significantly effective and quickly-acting prevention against the drifting of sand while the installation work at the venue is carried out in an extremely favorable fashion.

The columnar sandbags 2 are preferably placed in such a pitch that 3 to 30 sandbags are disposed for every ten meters. In addition, each sandbag with sand being enclosed therein should preferably have a cross-sectional area of 10 to 400 $cm^2$ (the cross-sectional area taken in the direction perpendicular to the longitudinal direction of the sandbag).

The tubular knit fabric mentioned in the present invention is made by knitting the fiber yarn in a tubular shape. Having been filled with sand, the ends of the tube are processed so as not to allow the sand to leak out before the tube is used as a so-called sandbag. The use of the tubular knit fabric prevents the fine sand from leaking out through the stitched-up portion or through the stitches, and also prevents the sandbag from tearing up. In addition, the tubular knit fabric is transformed into narrow and long-shaped columnar sandbags efficiently. Accordingly, the use of the tubular knit fabric allows the installation work to be carried out with ease when the sandbags are installed in a vast area. Various ways of closing the ends on both sides may be employed, such as sewing, adhesive bonding, fusing, tying a knot, and tying with a string that is separately prepared for this purpose. Above all, tying with a string is preferable since the secure closing can be obtained inexpensively and easily by this means.

Making the sandbags is carried out on the sandy soil at the venue for the installation. Accordingly, continuous tubular knit fabric without the sand to be filled therein is transported to the venue in an appropriately wound-up form. Once reached the venue, the continuous tubular knit fabric is cut into pieces of appropriate lengths. Then, an end of each peace is closed and then sand is filled and enclosed therein, followed by the closing of the other end.

In addition, when taking account of the handling easiness during the installation work and of the possible change that may occur after the installation in the surrounding of the sandbags, it is preferable to perform processing, by any method, to form a blockade somewhere in a central portion, that is, the portion other than the two ends of the sandbag. It is preferable because, the blockage prevents the sand, which is the content of the sandbag, from moving unnecessarily. Incidentally, the use of woven fabric is not suitable for the purpose because making woven fabric into a tubular shape needs sewing or hollow weaving with a special loom. In addition, common woven fabric is less elastic than knit fabric. Accordingly, sandbags made of woven fabric cannot have a good effect of preventing the sand drift especially because placement of such sandbags so as to fit to the irregular terrain surface and the like is nearly impossible.

In addition, the use of unwoven fabric is not suitable for the purpose because of the need for the sewing as in the case of woven fabric. Moreover, the kind of unwoven fabric that is tough enough to withstand the filling of sand has poor elasticity in most of the cases. Accordingly, the use of the unwoven fabric is also not preferable because sandbags of such fabric cannot be placed to fit to the irregular terrain surface and the like. Furthermore, the use of plastic films or sheets manufactured by such methods as blow forming is not preferable either. This is because such materials, though being light in weight, are poor in their tensile strength, tear strength, abrasion resistance, and durability. Another reason is that sandbags made of these materials, which nearly lack elasticity, cannot be placed to fit to the irregular terrain surface and the like as in the cases of the woven fabric and of unwoven fabric.

The sandbag used in the present invention is formed by filling the tubular knit fabric with sand, and, as a result, has a shape that is approximately similar to a circular column. Once being installed, the sandbag may be changed in shape from the original columnar shape by the weight of its content, that is, the sand.

The sandbag of knit fabric having stretchability can be changed in shape easily by the weight of the sand filled therein and in accordance with the irregularity of the terrain surface. Accordingly, the sandbag is placed on the ground so as to fit to the terrain surface with no gap created in between. Consequently, the sandbag is more effective in stopping the sand drift, so that the sandbag is preferable for the purpose. It is important that the sandbag is made of tubular knit fabric especially for the following reason. Even when the sandy terrain surface changes its irregularity as time goes by after the placement of the sandbag, the sandbag can follow and fit to the newly-created irregularity.

The cross-sectional area of the sandbag taken in the direction perpendicular to the longitudinal direction of the sandbag is preferably 10 to 400 $cm^2$ when the sandbag is filled with sand. A cross-sectional area smaller than 10 $cm^2$ is less effective in serving as a sandbag to press down the sandy soil and in blocking the wind, so that it is difficult to obtain effects as expected from a sandbag with such a small cross-sectional area. Even when such sandbags are placed densely in a smaller pitch, the use of such sandbags sometimes fails to stop the drift of sand effectively.

In contrast, the sandbag of a cross-sectional area larger than 400 $cm^2$ is heavier in weight and is less easy to be worked with. Nevertheless, the increase of the effects of stabilizing the sandy soil thus obtained is not worth the heavier weight any longer. This means the use of the sandbags becomes less efficient for the purpose. Accordingly, such a sandbag of a larger cross-sectional area is not preferable for the purposes of stopping the drift of sand for a certain period of time and of making effective use of the land being worked on, as early as possible. The length of each sandbag can be freely determined, but a preferable length is 1 to 20 m. This is because a series of sandbags of such a length is easier to be worked with.

The sandbags are placed in a way that plural sandbags are arranged so as to cross over one another. The crossing points thus formed contribute to effective prevention against the drifting and the flying-away of sand. There is no such thing as the only way or the only form of crossing. It is possible, for example, that sandbags are arranged so as to form triangles with three sandbags are made to cross over one another at each crossing point. As far as the inventors have found out, a way in which sandbags are crossed perpendicularly to one another so as to form a grid pattern is preferable from the viewpoint of the installation easiness. The crossing of sandbags creates difference in level, but the sandbags of the tubular knit fabric employed in the present invention fit to the thus-created step-shaped portions with the help of the stretchability that the knit fabric has. Accordingly, the sandbags are placed easily on the ground with no gap created between the sandbags and the terrain surface.

In the present invention, such a pitch that 3 to 30 sand sandbags are disposed for every ten meters is preferable. Even when sandbags of a larger cross-sectional area are employed, placement of less than three sandbags for every ten meters leaves a large bare-ground part in the center portion of every partitioned sandy soil. This sometimes allows the drifting and the flying-away of sand to take place on a greater scale, thus sometimes failing to settle down the sand. In contrast, placement of more than 30 sandbags for every ten meters results in a longer total length of the sandbags installed for every unit area (and eventually results in a larger area with sandbags being installed). This is against the principle of making effective use of sandbags and the load for the installation work becomes heavier. Accordingly, such a high pitch is not suitable under common circumstances.

Combining the cross-sectional area and the placement pitch appropriately within the respective ranges described above is important because these factors are related to the effectiveness of or the period of time for the sand drift prevention, and to the point of time when the vegetation change is completed.

In the present invention, the sand filled in the sandbags may be obtained from any source. Here, the use of the sand existing in the venue for the installation is preferable because the use allows more efficient transportation and because the use does not unnecessarily change the environment or the biological ecosystem of the venue.

The volume of sand filled in sandbags is preferably set to meet 0.1 $m^3$ to 50 $m^3$ for every 100 square meters of the site. No matter how the cross-sectional area, the placement pitch, and the crossing way are adjusted, it is difficult for sandbags with sand of less than 0.1 $m^3$ for every 100 square meters of the site to achieve the object that has been expected, that is, a favorable effect of stopping the drift of sand. In addition, sandbags with sand of more than 50 $m^3$ for every 100 square meters of the site are against some of the objects that have been expected in the present invention, that is, efficiently stopping the drift of sand with sandbags with small amount of sand and thus minimizing the use of resources. Note that one of the characteristic features of the present invention is its smaller volume of sandbags used for every unit area, which is preferably made no more than 50 $m^3$ for every 100 square meters.

There is no such thing as the only way of filling the sandbag with sand. An example of preferable ways is disclosed in Japanese patent application Kokai publication No. 2005-110590. In the disclosed way, a tubular adaptor is used. Sand (culture soil) is poured into the tubular adaptor and is then transferred to the tubular fabric. Moreover, in this preferable way, the use of an apparatus equipped with a hopper attached to the tubular adaptor is more preferable as such an apparatus allows an easy filling work. In a still more preferable way, the above-described apparatus is equipped, in the ends of legs, with wheels that are made broad width enough to keep from being buried in the soft sandy soil. Once a sandbag is filled with sand, the apparatus is moved in the direction to the place where the sandbag is to be placed. Accordingly, the placement of the sandbags is carried out almost simultaneously with the making of the sandbags, so that the work for sandbag transportation is simplified.

In the present invention, the fiber material used for the tubular knit fabric can be any one of the natural fibers, recycled fibers, and synthetic fibers. In addition, plural types of any one of these fibers can be used together in such forms as mixed spun yarn, combined filaments yarn, and yarn mix knitting.

Both the natural fibers and the recycled fibers are supposed to be made from raw materials of biologic origin and to be biodegradable. The use of such fibers is preferable in the present invention for the following reason. Once the sandy soil is stabilized with plants taking root and being fixed in the soil, sandbags are no longer necessary. However, even in this case, there is no need for the sandbags of such fibers to be collected.

The use of synthetic fibers is preferable for the following reasons. Inexpensive, stable-quality continuous fiber (filament) is obtainable so that the use of synthetic fibers renders the processing to make yarn and knit fabric easier. In addition, common synthetic fibers are more durable than natural or recycled fibers. Accordingly, the use of synthetic fibers makes the maintenance and the management after the installation easier.

Polylactic-acid based fibers are the most preferable fibers to be used in the present invention.

Polylactic-acid based fibers are made from biomass that is originated from plants, thus being biodegradable. The polylactic-acid based fibers also have one of the advantageous properties of synthetic fibers: inexpensive, stable-quality continuous fiber (filament) is obtainable. In addition, polylactic-acid based fibers are strong and heat resistant to an adequate degree. Accordingly, the use of polylactic-acid based fibers renders the processing easier. Moreover, polylactic-acid based fibers are excellently light-resistant and are also durable to an adequate degree. Incidentally, once the sandbags are installed, it takes more than 2 to 5 years for the sandy soil to be stabilized, for plants to take root and to be fixed in the soil. At this point, sandbags are no longer necessary. Polylactic-acid based fibers are durable, light-resistant, and weather-resistant enough to serve for this period of time, but are eventually decomposed into carbon dioxide and water. Accordingly, the use of polylactic-acid based fibers makes the cleaning-up of the sandbags at a later time unnecessary. In other words, the polylactic-acid based fibers have a big advantage of being eco-friendly fibers.

The polylactic-acid based fibers mentioned in the present invention are fibers made from polylactic-acid based resin by the melt-spinning method. Lactic-acid polymers include polylactic-acid based homopolymer as well as lactic-acid copolymer and blend polymer. Lactic-acid polymers have a weight average molecular weight of 50 thousands to 500 thousands in general. In addition, the lactic-acid polymer may have a constituent molar ratio L/D between L-lactic acid unit and D-lactic acid unit of 100/0 to 0/100. It is, however, preferable that the lactic-acid based polymer contain any one of L-lactic acid unit and the D-lactic acid unit of 75 mole % or higher so as to achieve a high melting point. Furthermore, it is preferable that the lactic-acid based polymer contain any one of L-lactic acid unit and the D-lactic acid unit of 90 mole % or higher so as to achieve a still higher melting point.

Lactic-acid copolymer is formed through the copolymerization of lactic-acid monomer or lactide with other substances that can be copolymerized with these. Some of the examples of such other substances are: dicarboxylic acid having two or more ester-bond forming functional groups; polyvalent alcohol; hydroxycarboxylic acid; lacton; and the like. Other examples are the following various substances containing the above-mentioned various constituents: various polyesters; various polyethers; various polycarbonates; and the like. In addition, for the purpose of increasing molecular weight, a method of increasing molecular weight by use of a small dose of chain extenders may be employed. Examples of the chain extenders are diisocyanate compounds, such as hexamethylenediisocyanate, isopholonediisocyanate, and xylylenediisocyanate, diphenylmethanediisocyanate. Alternatively, a method of obtaining aliphatic polyestercarbonate by use of a carbonate compound may be employed for the purpose.

Moreover, the lactic-acid based polymer may contain additives, such as antioxidants, or other particles as long as the addition does no harm to the characteristic property of the lactic-acid based polymer. In the case of using polylactic-acid fiber yarn, it is preferable that the amount of carboxyl terminals be 10 equivalent-weight/t or smaller. An amount of carboxyl terminals of 10 equivalent-weight/t or smaller can retard the hydrolysis of the polylactic-acid fiber. A possible way of achieving the amount of carboxyl terminals of 10 equivalent-weight/t or smaller is the sequestering, carried out at the stage of raw material resin, of the carboxyl terminals of the polylactic acid. Such sequestering is achieved, for example, by the reaction with the terminals by use of condensation-reaction type compounds, such as aliphatic alcohols and amide compounds, or by use of addition-reaction type compounds, such as carbodiimide compounds, epoxy compounds, oxazoline compounds and aziridine compounds. A reaction by use of the latter type compounds, that is, the addition-reaction type compounds, has no need to discharge unnecessary by-products out of the reaction system, while such discharging is necessary in the case of sequestering terminals through, for example, a dehydration-condensation reaction of alcohol and carboxyl group. Accordingly, in the case of using the addition-reaction type compounds, the type of compounds can be added, mixed and made to react during the melt-spinning process of the polylactic acid. The use of addition-reaction type compounds is therefore advantageous for the purpose of obtaining a reaction product with a molecular weight, heat resistance, and hydrolysis resistance all of which are high enough for the product to be used in practice.

A preferable method is the addition, to the polylactic acid, a carbodiimide compound among the above-mentioned addition-reaction type compounds. Sequestering, with the carbodiimide compound, the reaction-active terminals of the polylactic-acid polymer or of the oligomer contained therein inactivates the reaction-active terminals in the polymer and thus retards the hydrolysis of the polylactic acid. What is preferably used as the carbodiimide compound mentioned here is the one made by the polymerization of diisocyanate compound as described in Japanese patent application Kokai publication No. Hei 11-80522. Above all, a polymer of 4, 4'-dicyclohexylcarbodiimide, a polymer of tetramethylxylylenecarbodiimide, and those substances with their respective terminals sequestered with polyethyleneglycol are some of the preferable examples of the carbodiimide compounds mentioned above.

The carbodiimide compound is used to sequester the reaction-active terminals of the polylactic-acid polymer and the oligomer contained therein, thus to inactivate the reaction-active terminals in the polymer, and eventually to retard the hydrolysis of the polylactic acid. The reaction-active terminals include hydroxyl group and carboxyl group. The carbodiimide compound is excellent in sequestering the carboxyl-group terminals. The amount of the carbodiimide compound to be added is determined with reference to the amount of carboxyl terminals. In addition, since the residual oligomer of lactide and the like also produces carboxyl terminals through hydrolysis, a preferable amount of the carbodiimide compound to be added is equal to or less than the twice the equivalent weight to the amount of the total carboxyl terminals that include not only the carboxyl terminals in the polymer but also the carboxyl terminals originated from the residual oligomer or monomer. With the terminals sequestered, a dramatic improvement in the hydrolysis resistance is achieved by a total carboxyl terminal concentration of 10 equivalent weight/t or smaller to the total polylactic acid. Accordingly, such a concentration is preferable.

Various types of conventional knitting machines and of conventional knitting stitches can be employed in a knitting method used for the tubular knit fabric. A preferable method to be employed is to knit a plain stitch by use of a circular knitting machine, which is capable of knitting tubular knit fabric, because the method provides excellent productivity.

The tubular knit fabric used in the present invention preferably has a cover factor of 5 to 20, which is measured in accordance with JIS L 1018 8.10. A cover factor within this range generally reduces the leaking-out of the sand through the mesh while the installation work is going on and while the sandbags are under the post-installation environment. There is no particular limitation on the weight for the tubular knit fabric, but a preferable weight is in a range from 50 to 500 g/m$^2$ from the viewpoint of durability and strength that are high enough to resist the leaking-out of the sand. Nor is there any limitation on the thickness of the knitting yarn, but a preferable thickness is in a range from 50 to 500 dtex.

Furthermore, stabilization of sandy soil that is mobile under conventional circumstances can be achieved according to the sand drift prevention method of the present invention. While the method of the present invention is employed, the seeding of the plants for the desired vegetation and transplanting the seedlings of the plants are to be done to the sandy soil surface (the ground surfaces surrounded by the sandbags and the area around the sandbags). Accordingly, an environment in which desired plants grow can be created, and thus the vegetation of the land in question can be improved.

If the effect of stopping the sand drift was the only target of the invention, sandbags that remain semi permanently with their effect simply remaining likewise might be enough for the purpose. However, the kind of sandbags may somehow be inappropriate from the viewpoint of maintaining the natural environment. In contrast, the use of the sandbags of the polylactic-acid fibers is very useful in view of the environmental conservation. This is because the sandbags of the polylactic-acid fibers keeps its effect of stopping the sand drift favorably for a certain period of time, and allows the improvement of vegetation to a certain extent within the period to "leave it to the nature" after the period.

EXAMPLES

The present invention will be described below in further detailed fashion by way of examples. The following methods are employed to measure physical properties.

A. Cover Factor

The cover factor was measured in accordance with JIS L 1018 8.10 (1999). The filament size of the filament labeled by the count per unit weight was obtained through the conversion into the filament size (tex).

B. Cross-Sectional Area of Sandbag

Cross sections of a sandbag placed straight on a flat surface were taken by the planes that are perpendicular to the longitudinal direction of the sandbag. For each of these cross sections, the maximum diameter and the minimum diameter were found, and the average value of the two diameters thus obtained was defined as the average diameter. Average diameters were found at five positions in total of the sandbag: at two positions that are away from the respective ends of the sandbag by 15 cm; and three positions in the center portion (except the portion with the blocking being processed). Then, the average value of the five average diameters was calculated as the diameter D (cm). By using the diameter D, the cross-sectional area A (cm$^2$) of the sandbag was calculated in accordance with the following formula.

$$A=D^2\times n/4$$

where n is the circle ratio.

C. Volume of Sand Filled in Sandbags Relative to Sandy-Soil Area of Installation Target When the sandy-soil area of the installation target was larger than a 10-m square, the volume was obtained by measuring the cross-sectional area and the length of each of the sandbags located within a randomly-defined square of the size. When the sandy-soil area of the installation target is smaller than the above-mentioned size, an area defined by imaginary lined connecting sandbags placed on the outer most boundary of the area was measured. The volume of sand of sandbags in the thus-measured area was converted into the volume for 100-m$^2$ unit area. In the case of a triangular area with the ground for the measurement of the length and the height being undulated, the area may vary in accordance with which one of the sides is assumed to be the base of the triangle. In this case, the length of the base and the height of the triangular were obtained with each of the three sides being assumed as the base line, and the average value of the three areas thus calculated was obtained. In the case of a polygonal area with four or more sides, the polygon was divided into freely-chosen triangles, and the areas for the respective triangles were added together. Otherwise, that is, in the case of an area of a shape with a curved contour, the shape was approximated by triangles or quadrilaterals. Note that when an undulated ground had to be measured, the measurement was done by placing a string-like material, such as a rope, so as to follow the undulated surface of the ground.

D. Relative Viscosity

A 98% sulfuric-acid solution of 0.01 g/mL was prepared and measured at 25° C.

E. Melt Viscosity

Capillograph 1B available from Toyo Seiki Seisaku-Sho Ltd. was used. Three measurements were conducted in a nitrogen atmosphere at a measurement temperature of 240° C., and at a shear rate of 1216 $sec^{-1}$, and the average value of the three measurement results was calculated as the melt viscosity.

Example 1

Melt spinning was performed for a polylactic-acid resin (relative viscosity of 3.42, melt viscosity of 200 $Pa \cdot sec^{-1}$, melting point of 168° C.) by a conventionally-known method, and thus obtained was a partially-oriented yarn of 106 dtex and 26 filaments. Two yarns of this kind were combined, then drawn and then false-twisted. Thus obtained was a two-heater textured 2-ply yarn of 84 dtex, 26-filaments. Using this yarn, plain knitting was performed by use of a circular knitting machine with 3.5-inch pot size and of 22 gauges. Thus obtained was a tubular knit fabric with a cover factor of 12.3. An end of the tubular knit fabric was closed by tying with a string. Then, while sand was filled from the other side of the tube, closings were formed with strings at intervals of 2 to 3 m. Thus fabricated were 22 sandbags each of which was 10 m long.

The cross-sectional area of each sandbag was 50.2 $cm^2$ while the volume of the sand filled in each sandbag was 0.050 $m^3$.

These sandbags were placed on a substantially flat surface of sandy soil of a sand dune. The sandbags were placed in an area of 100 $m^2$ in such a pitch that 10 sandbags are disposed for every ten meters, thus arranged in a grid pattern so as to cross over perpendicularly to one another. Accordingly, the volume of the sand filled in the sandbags for the area of 100 $m^2$ was 1.10 $m^3$. The sandbags were then left as they were for two months and observation was conducted to find if there was a change in the height of the sandy soil and in the shape of the sandbags. No change was observed. That is, a large effect of stopping the sand drift was demonstrated.

Example 2

Using a polyethylene terephthalate (PET) false-twist textured yarn (167 dtex, 48 filaments, B20Z) available from Toray Industries Inc., plain knitting was performed in a similar manner to that in Example 1. Thus obtained was a tubular knit fabric with a cover factor of 10.3. An end of the tubular knit fabric was closed by tying with a string. Then, while sand was filled from the other side of the tube, closings were formed with strings at intervals of 2 to 3 m. Thus fabricated were 22 sandbags each of which was 10 m long.

The cross-sectional area of each sandbag was 55.5 $cm^2$ while the volume of the sand filled in each sandbag was 0.056 $m^3$.

Then, using these sandbags, a test was conducted in a way that is similar to the one in Example 1. A favorable effect of stopping the sand drift was obtained as in the case of Example 1.

Note that, the raw material of the tubular knit fabric of Example 2 was PET fiber. The material would not be decomposed in the natural environment and would remain semi permanently. Accordingly, the sandbags were removed when the test was finished. Specifically, the raw material of the tubular knit fabric of Example 2 was the PET fiber, so that it was expected that PET fiber would decay as the molecule weight was lowered down by the ultraviolet degradation. The fragments produced by the decay might possibly fly away, but would not be decomposed in the natural environment. Accordingly, the fragments would remain semi permanently. For this reason, the sandbags were removed when the test was finished.

Example 3

Using a blended yarn of cotton count of 40 with 70% cotton and 30% polyester staple fiber of 3.3 dtex and of a 38-mm fiber length, plain knitting was performed in a similar manner to that in Example 1. Thus obtained was a tubular knit fabric with a cover factor of 11.3. An end of the tubular knit fabric was closed by tying with a string. Then, while sand was filled from the other side of the tube, closings were formed with strings at intervals of 2 to 3 m. Thus fabricated were 22 sandbags each of which was 10 m long.

The cross-sectional area of each sandbag was 39.1 $cm^2$ while the volume of the sand filled in each sandbag was 0.039 $m^3$.

Then, using these sandbags, a test was conducted in a way that is similar to the one in Example 1. A favorable effect of stopping the sand drift was obtained as in the case of Example 1.

Comparative Example 1

Sandy soil of the same testing field used in Example 1 and 2 was left as it was for two months with no sand drift prevention method used and observation was conducted to find if there was a change in the height of the sandy soil. A change in the height of the sandy soil and a sand drift phenomenon were observed. The result shows the advantage of Examples 1 and 2 over Comparative Example 1.

Comparative Example 2

Using a polyethylene terephthalate (PET) false-twist textured yarn (167 dtex, 48 filaments, B20Z) available from Toray Industries Inc., plain knitting was performed by use of a circular knitting machine with 30-inch pot size and of 28 gauges. Thus obtained was a tubular knit fabric with a cover factor of 11.5. An end of the tubular knit fabric was closed by tying with a string. Then, sand was filled from the other side of the tube. Thus fabricated were 12 sandbags each of which was 4 m long. The cross-sectional area of each sandbag was 4558 $cm^2$ while the volume of the sand filled in each sandbag was 1.82 $m^3$.

Figure 2:
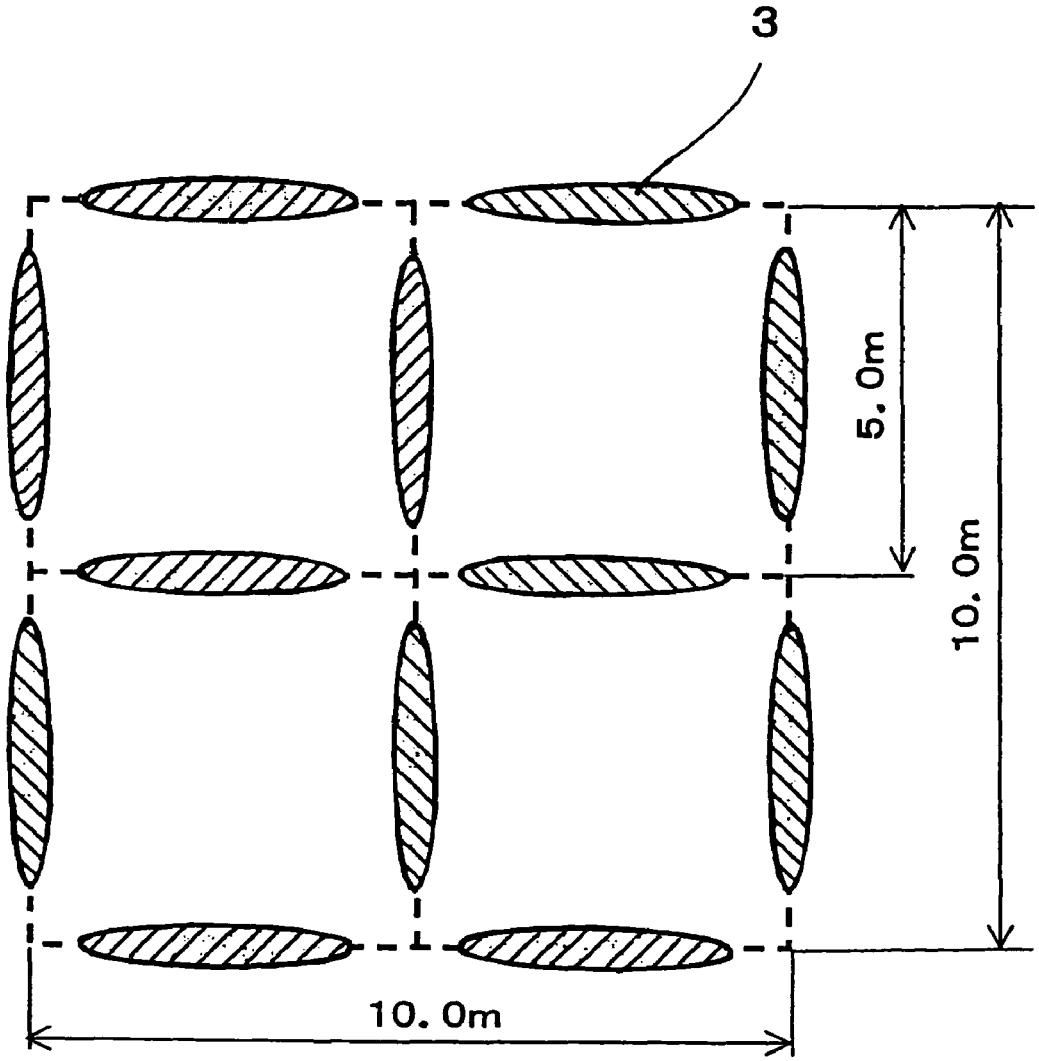
FIG. 2 is a plan view showing, for the purpose of comparing with the sand drift prevention method according to the present invention, a rough model of a way of placing sandbags employed in Comparative Example 2.

These sandbags were placed on a substantially flat surface of sandy soil of a sand dune. The sandbags were placed in a 10-m square with an area of 100 $m^2$ in such a pitch that 2 sandbags are disposed for every ten meters as shown in FIG. 2. The sandbags 3 were placed so as not to cross over one another. The sandbags were then left as they were for two months and observation was conducted to find if there was a change in the height of the sandy soil. A change in the height of the sandy soil and a sand drift phenomenon were observed. The effect of stopping the sand drift in Comparative Example 2 is markedly smaller than the effect in any one of the cases of Examples 1 to 3. The result shows the advantage of Examples 1 to 3 over Comparative Example 2.

INDUSTRIAL APPLICABILITY

The sand drift prevention method of the present invention can be employed as a means, with a large effect of stopping the sand drift, for reducing the damages caused by the sand flying away in a mobile desert area or the near-by areas of sandy soil.

The sandy soil can be stabilized. Accordingly, while the method of the present invention is applied, seeds of the plants of the vegetation desired for the sandy soil to which the method is applied can be sown and the seedlings of the plants of the kinds can be transplanted. As a result, an environment in which desired plants grow can be created, and thus the vegetation of the land in question can be improved.

As has been described thus far, the present invention is very useful for the purpose of maintaining the natural environment of the earth.

What is claimed is:

1. A sand drift prevention method characterized in that a plurality of columnar sandbags made of a tubular knit fabric knitted by use of a polylactic-acid fiber with sand being filled inside the columnar sandbags, the cross-sectional area of each of the columnar sandbags being 10 to 400 $cm^2$, are arranged at such a pitch that 3 to 30 sandbags are disposed for every ten meters on a sandy soil surface so as to cross over one another and form a grid pattern, whereby each grid surrounds a portion of the sandy soil surface, and thereby drifting of sand due to the force of wind is prevented, and wherein the volume of sand filled in the sandbags is 0.1 $m^3$ to 50 $m^3$ for every 100 square meters of the sandy soil surface.

2. A tubular knit fabric for a columnar sandbag characterized in that the tubular knit fabric is employed in the sand drift prevention method according to claim 1.

3. The tubular knit fabric for a columnar sandbag according to claim 2 characterized in that the columnar knit fabric is knitted by use of a polylactic-acid fiber.

4. The sand drift prevention method according to claim 1, wherein the tubular knit fabric has a cover factor of 5 to 20, the cover factor being obtained in accordance with JIS L 1018.

5. A method of forming and improving the vegetation in sandy soil comprising the steps of:

preventing drift of sand by arranging a plurality of columnar sandbags made of a tubular knit fabric knitted by use of a polylactic-acid fiber with sand being filled inside the columnar sandbags, the cross-sectional area of each of the columnar sandbags being 10 to 400 $cm^2$, at such a pitch that 3 to 30 sandbags are disposed for every ten meters on a sandy soil surface so as to cross over one another and form a grid pattern, whereby each grid surrounds a portion of the sandy soil surface, and wherein the volume of sand filled in the sandbags is 0.1 $m^3$ to 50 $m^3$ for every 100 square meters of the sandy soil surface, growing a desired plant in the sandy soil surface exposed as being surrounded by columnar sandbags that are placed so as to cross over one another and form a grid pattern, and thereby the vegetation of the sandy soil surface is changed.

6. A tubular knit fabric for a columnar sandbag characterized in that the tubular knit fabric is employed in the method of forming and improving the vegetation in sandy soil according to claim 5.

7. The tubular knit fabric for a columnar sandbag according to claim 6 characterized in that the columnar knit fabric is knitted by use of a polylactic-acid fiber.

8. The method of forming and improving the vegetation in sandy soil according to claim 5, wherein the tubular knit fabric has a cover factor of 5 to 20, the cover factor being obtained in accordance with JIS L 1018.

* * * * *